US007654344B2

(12) United States Patent
Haughom et al.

(10) Patent No.: US 7,654,344 B2
(45) Date of Patent: Feb. 2, 2010

(54) TORQUE CONVERTER FOR USE WHEN DRILLING WITH A ROTATING DRILL BIT

(75) Inventors: Per Olav Haughom, Tonstad (NO); Nils Reimers, Bjoa (NO)

(73) Assignee: Tomax AS, Stavanger (NO)

( * ) Notice: Subject to any disclaimer, the term of this patent is extended or adjusted under 35 U.S.C. 154(b) by 72 days.

(21) Appl. No.: 11/813,920

(22) PCT Filed: Jan. 16, 2006

(86) PCT No.: PCT/NO2006/000019

§ 371 (c)(1),
(2), (4) Date: Feb. 7, 2008

(87) PCT Pub. No.: WO2006/075921

PCT Pub. Date: Jul. 20, 2006

(65) Prior Publication Data

US 2008/0202816 A1 Aug. 28, 2008

(30) Foreign Application Priority Data

Jan. 14, 2005 (NO) ..... 20050223

(51) Int. Cl.
*E21B 17/07* (2006.01)

(52) U.S. Cl. ..... 175/322; 175/57

(58) Field of Classification Search ..... 175/321–323, 175/424, 57

See application file for complete search history.

(56) References Cited

U.S. PATENT DOCUMENTS 3,156,106 A 11/1964 Crane
3,259,191 A * 7/1966 McClintcck et al. ..... 166/340
3,302,732 A * 2/1967 Roll ..... 173/205
3,805,606 A * 4/1974 Stelzer et al. ..... 73/152.48
4,280,606 A * 7/1981 Taylor ..... 464/40
4,281,726 A 8/1981 Garrett
4,443,206 A 4/1984 Teng
5,083,623 A 1/1992 Barrington
5,669,457 A * 9/1997 Sebastian et al. ..... 175/73
6,594,881 B2 * 7/2003 Tibbitts ..... 29/450
7,044,240 B2 * 5/2006 McNeilly ..... 175/57

FOREIGN PATENT DOCUMENTS

CA 2402035 A1 3/2004
EP 065 601 A1 12/1982
NO 315209 B1 7/2003
WO WO 97/01693 A1 1/1997
WO WO 2004/090278 A1 10/2004

OTHER PUBLICATIONS

International Search Report for parent application PCT/NO2006/000019, having a mailing date of Apr. 10, 2006.

* cited by examiner

*Primary Examiner*—Shane Bomar
(74) *Attorney, Agent, or Firm*—Andrus, Sceales, Starke & Sawall, LLP

(57) ABSTRACT

A torque converter for use in drilling with a rotating drill bit, the purpose of the torque converter being to absorb impacts and bring about an axial movement of the drill bit when the torque exceeds a predetermined value. For this purpose the torque converter is composed of two cylindrical string parts connected through the bearing elements. The string parts are connected to each other through helical elements in such a way that relative rotation of the two cylindrical string parts brings about axial movement, which unloads the drill bit.

5 Claims, 3 Drawing Sheets

TORQUE CONVERTER FOR USE WHEN DRILLING WITH A ROTATING DRILL BIT

CROSS-REFERENCE TO RELATED APPLICATIONS

This application is the U.S. national stage application of International Application PCT/NO2006/000019, filed Jan. 16, 2006, which International Application was published on Jul. 20, 2006, as International Publication No. WO 2006/075921 A1 in the English language. The International Application claims priority of Norwegian Patent Application 20050223, filed Jan. 14, 2005.

FIELD

This invention relates to a devise for use with a rotating drill bit, in which the aim is to absorb impacts and provide axial movement of the drill bit when, for a time, the torque exceeds a predetermined value.

BACKGROUND

Torque converters and dynamic dampers which have the purpose of dampening vibrations and limit the maximum torque in the drill string are known from the oil industry, among other things. In a drill string several thousand metres long, vibrations may occur due to the varying torque on the string. Such vibrations are most often caused by the drill bit hitting different rock formations, which involves that a varying load is applied to the drill string. Then, when the drill string is rotated by the torque from the drilling machine, great amounts of energy are stored, which are released when the drill bit suddenly breaks loose.

Uncontrolled release of energy leads to extreme stresses on the drill string and drill bit. Today's controllable drilling systems are provided with much electromechanical equipment, which may get damaged by extreme shocks and vibrations.

In the present invention the aim is to employ a device, which yields immediately and, by and by, seeks to pull the drill bit axially from the bottom whenever the torque exceeds a predetermined value.

Such a device is particularly well suited for modern drill bits with fixed cutters, in which industrially manufactured diamonds of high hardness are used, but in which the structure is brittle and sensitive to impacts.

Within the oil industry problems connected with overloading of the drill string are well known, and there has been worked continuously on different solutions to remedy the problems. In this connection, reference is made to the following patents.

NO 315209
GB 5,083,623
U.S. Pat. No. 4,281,726
GP 065 601 A1
U.S. Pat. No. 4,443,206
WO 97/01693

SUMMARY

In principle, the present invention has the same function as NO 315209, but the technical design is substantially different. In the present invention the axial movement is provided by means of a set of spring elements, whereas in NO 315209 the axial movement is achieved through a trapezoidally threaded connection and a separate spring package.

In relation to the state of the art the object of the invention is to provide a solution, which gives an immediate protective response and subsequently, by continued overload, contracts to reduce the axial load on the drill bit, so that it is freed. In relation to the state of the art, the invention has substantial advantages, while, at the same time, being simpler and more robust. Thereby the risk of breakdowns is reduced. In addition substantially lower costs for production and maintenance are achieved.

This is achieved in accordance with the invention by two cylindrical string parts being concentrically supported within each other and arranged for restricted axial and rotational relative movement relative to each other. The string parts are connected through a number of helical spring elements in such a way that relative rotation of the string parts leads to axial movement when the torque exceeds a given value.

This device is connected in the drill string immediately behind the main components of the bottom-hole string, for example a motor driven by drilling fluid, a data acquisition unit and a control system, or as an integral part of the bottom-hole assembly, when a rotating drill string is used.

BRIEF DESCRIPTION OF THE DRAWINGS

The invention will now be explained in further detail in connection with the description of an exemplary embodiment and with reference to the appended drawings, in which.

DETAILED DESCRIPTION OF THE DRAWINGS

Figure 1:
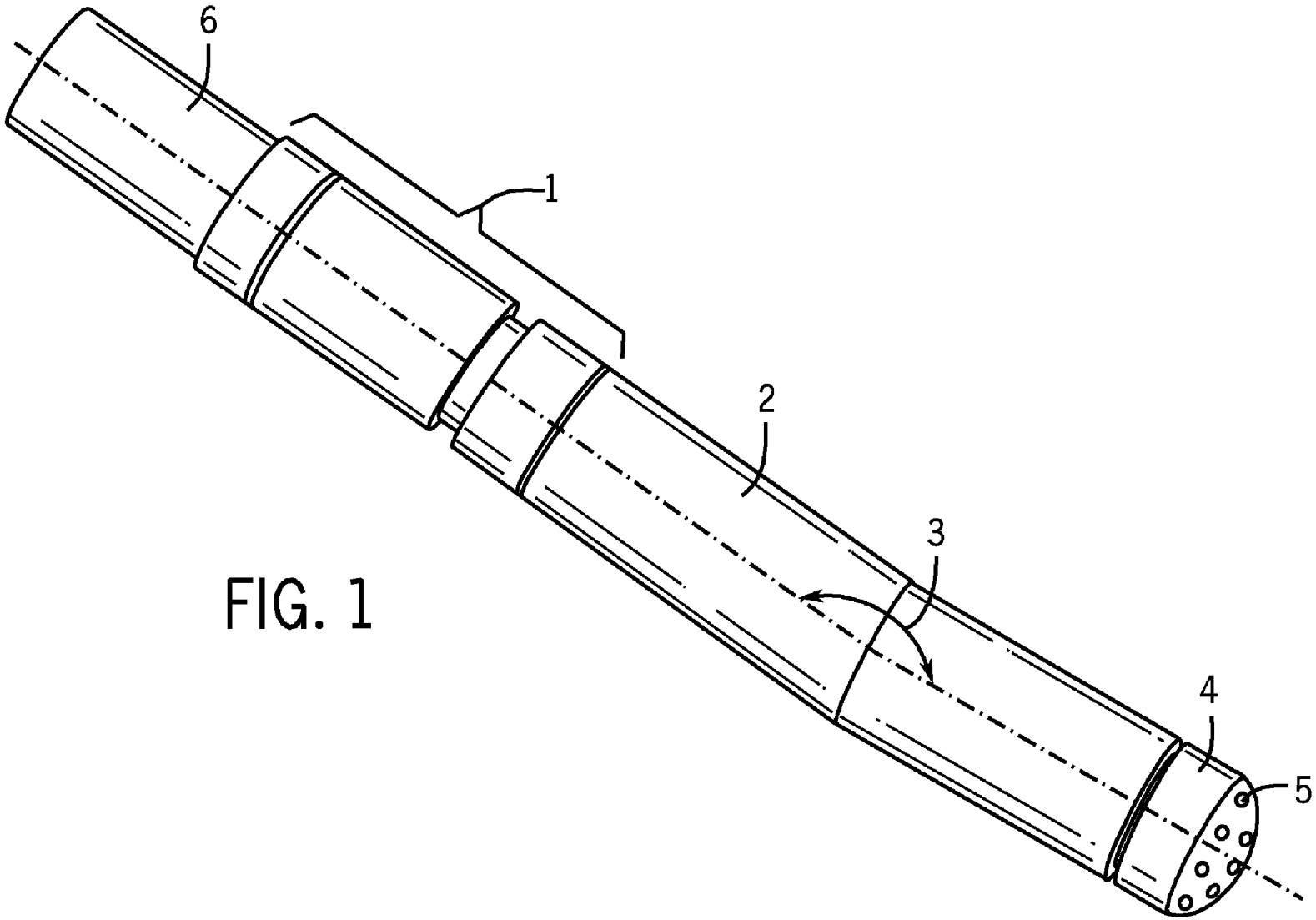
FIG. 1 shows the positioning of the invention relative to a drill string and mud motor.

In FIG. 1 numeral 1 indicates the invention fitted between a drill string 6 and a motor 2 driven by drilling fluid connected through the angular joint 3 to the drill bit 4 arranged with fixed shears 5.

Figure 2:
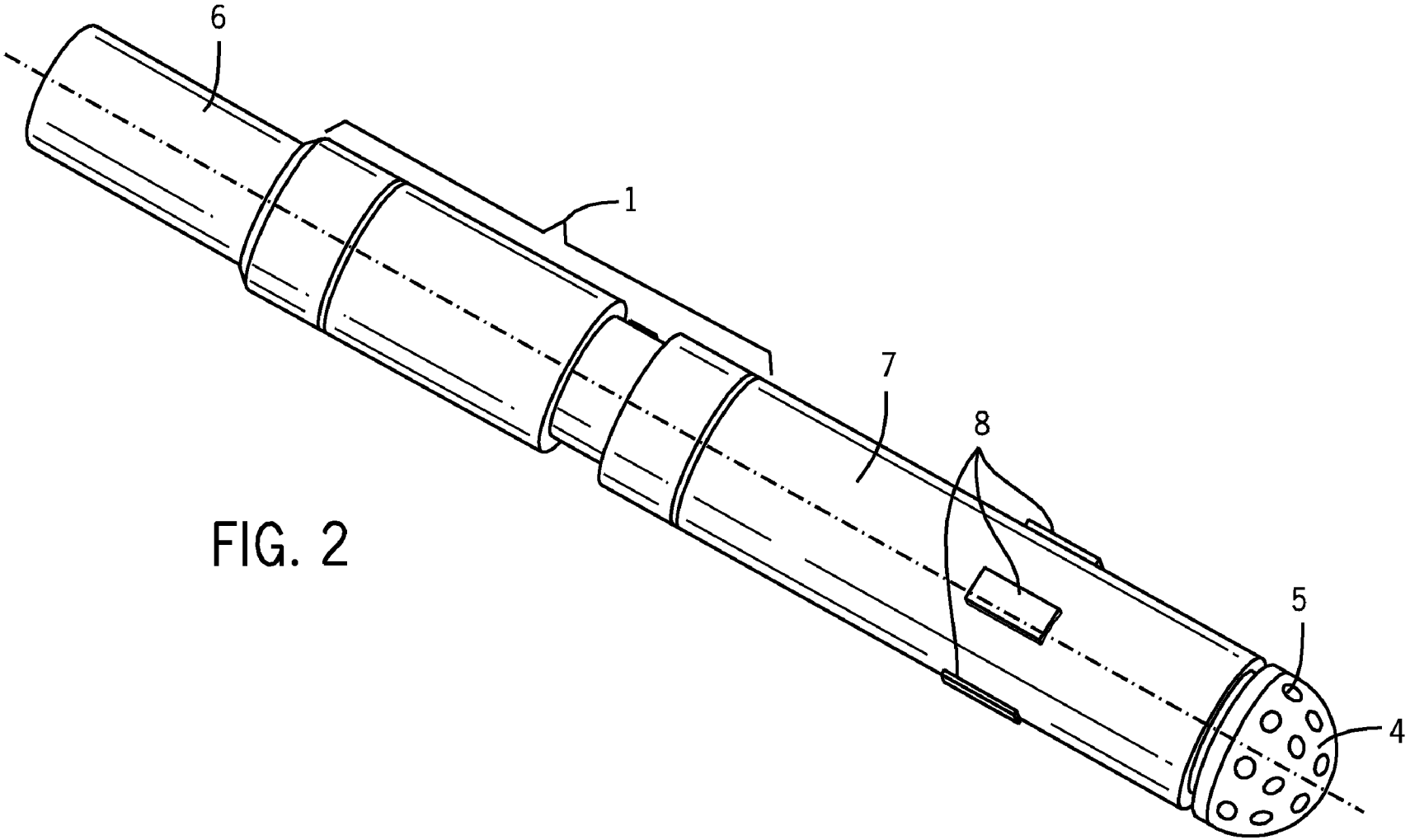
FIG. 2 shows the positioning of the invention relative to the bottom-hole assembly, in a rotating drill string.
Figure 3:
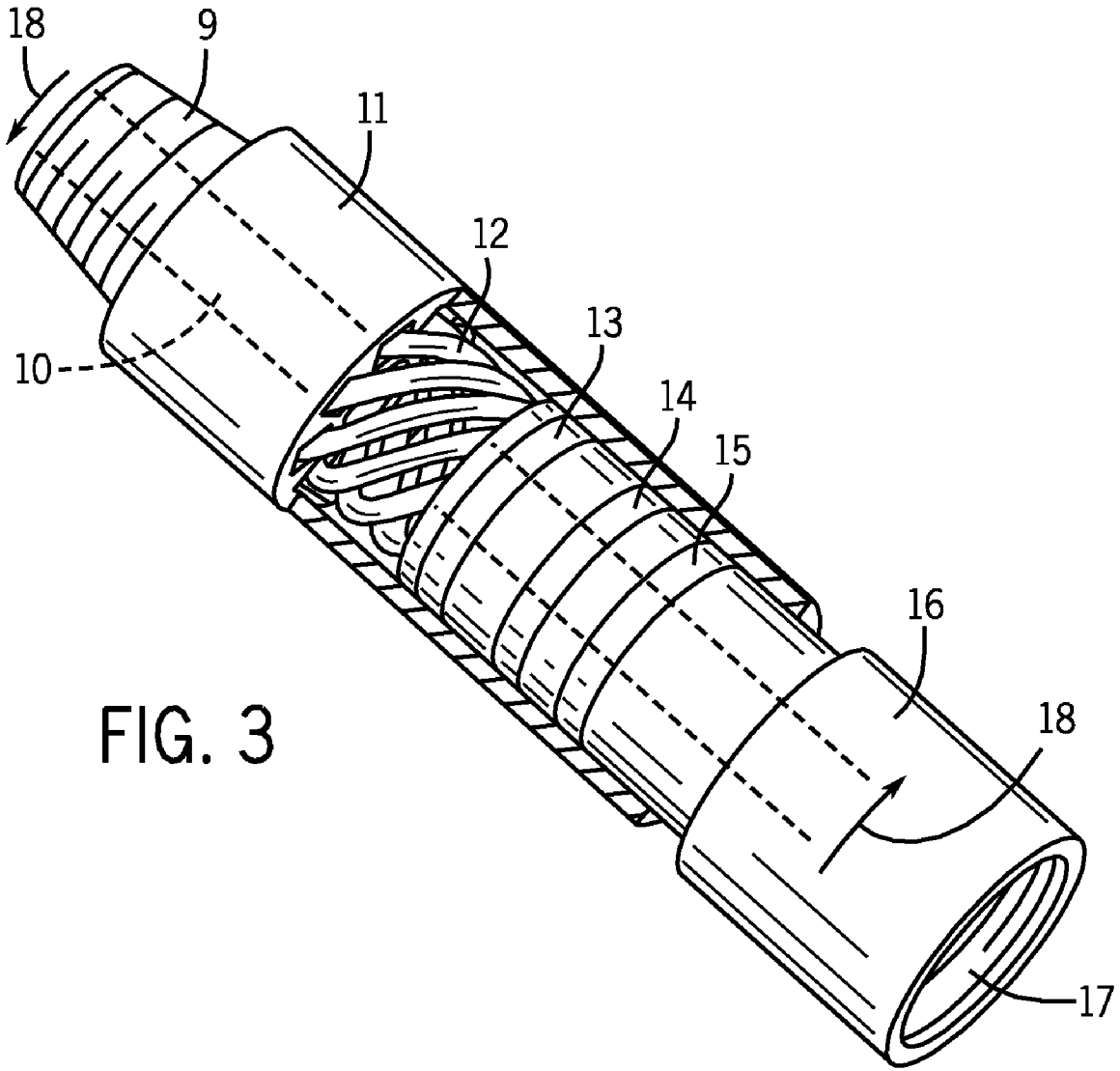
FIG. 3 shows the invention with a cylindrical string part partly in section.

In FIG. 2 is shown alternative positioning of the invention 1 inserted between a rotating drill string 6, a direction control unit 7 with guide pads 8 and a drill bit 4 with fixed shears 5.

An upper cylindrical string part 11 with threads 9 is supported concentrically on a lower cylindrical string part 16 through the bearing elements 13 and 15.

The string parts are connected to each other through helical elements 12 in such a way that relative rotation of the two cylindrical string parts brings about an axial movement.

By varying the thickness, helical pitch and materials of the spring elements 12 the torque 18 giving the desired axial movement, is determined.

Through the upper and lower string parts there is a through hole 10. The sealing element 14 seals against internal overpressure.

The invention claimed is:

1. In a drill string that extends along an axis from an uphole direction to a downhole direction, a torque converter comprising:

upper and lower cylindrical string parts, each comprising an uphole end and a downhole end;

helical spring elements operatively connecting the downhole end of the upper cylindrical string part to the uphole end of the lower cylindrical string part;

wherein the helical spring elements limit otherwise free relative axial and counter-rotational movement of the upper and lower cylindrical string parts with respect to each other;

wherein relative counter-rotational movement of the upper and lower cylindrical parts in a first direction causes the helical spring elements to contract along the axis, and thus move the lower cylindrical string part in the uphole direction;

wherein relative counter-rotational movement of the upper and lower cylindrical parts in a second, opposite direction causes the helical spring elements to expand along the axis, and thus move the lower cylindrical string part in the downhole direction; and wherein a predetermined amount of torque applied to the drill string during drill string operation causes relative counter-rotational movement of the upper and lower cylindrical parts in the first direction and thus results in movement of the lower cylindrical string part in the uphole direction.

2. The torque converter according to claim 1, comprising at least one guide element disposed between the upper and lower cylindrical string parts.

3. The torque converter according to claim 1, comprising at least one seal disposed between the upper and lower cylindrical string parts.

4. The torque converter according to claim 1, comprising a drill string having a downhole end and a drill bit operably connected to the downhole end, and wherein the torque converter is incorporated into a drill string such that relative rotation movement of the upper and lower cylindrical parts causes the drill bit to retract in the uphole direction away from a drilling surface.

5. A method of operating the torque converter of claim 4 comprising the step of operating the drill string until a predetermined amount of torque is applied to the helical spring elements to thus retract the drill bit in the uphole direction away form the drilling device.

* * * * *